US007822360B2

(12) United States Patent
Oh

(10) Patent No.: US 7,822,360 B2
(45) Date of Patent: Oct. 26, 2010

(54) IMAGE FORMING APPARATUS INCLUDING LOCKING UNIT

(75) Inventor: Jin-kyu Oh, Anyang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1034 days.

(21) Appl. No.: 11/588,350

(22) Filed: Oct. 27, 2006

(65) Prior Publication Data

US 2007/0104508 A1 May 10, 2007

(30) Foreign Application Priority Data

Nov. 10, 2005 (KR) ..... 10-2005-0107639

(51) Int. Cl.
*G03G 15/08* (2006.01)

(52) U.S. Cl. ..... 399/121

(58) Field of Classification Search ..... 399/121
See application file for complete search history.

(56) References Cited

U.S. PATENT DOCUMENTS 6,601,991 B2 8/2003 Sampe
2002/0021916 A1* 2/2002 Wakana ..... 399/121
2004/0136759 A1* 7/2004 Park ..... 399/302
2006/0225592 A1* 10/2006 Lee ..... 101/479

FOREIGN PATENT DOCUMENTS

| | | |
|---|---|---|
| JP | 11-133767 | 5/1999 |
| JP | 2001-315991 | 11/2001 |
| JP | 2002-089547 | 3/2002 |
| KR | 1999-41159 | 12/1999 |

* cited by examiner

*Primary Examiner*—David M Gray
*Assistant Examiner*—Andrew V Do
(74) *Attorney, Agent, or Firm*—Staas & Halsey LLP

(57) ABSTRACT

An image forming apparatus includes a main body, a roller detachably attached to/from the main body, a supporting member supporting a rotary shaft of the roller, and a locking unit which includes a locker frame and a locker arm. The locker arm is elastically biased toward the locking position and is moved to a releasing position when a user pushes the locker arm. In addition, the locker arm is movably coupled to the locker frame fixed on the main body, and installed on the main body in a state where the locking unit is assembled in advance. Therefore, assembling processes of the apparatus can be simple, and a user can assemble the apparatus easily.

28 Claims, 5 Drawing Sheets

IMAGE FORMING APPARATUS INCLUDING LOCKING UNIT

CROSS-REFERENCE TO RELATED APPLICATIONS

This application claims the benefit of Korean Patent Application No. 2005-107639, filed on Nov. 10, 2005, in the Korean Intellectual Property Office, the disclosure of which is incorporated herein by reference.

BACKGROUND OF THE INVENTION

1. Field of the Invention

Aspects of the present invention relate to an image forming apparatus, and more particularly, to an image forming apparatus including a roller which is detachably coupled to a main body of the image forming apparatus.

2. Description of the Related Art

In general, image forming apparatuses, including, for example, printers, copying machines, scanners, facsimiles, and multi-function peripherals, include printing units which print images on printable media, such as paper. The image forming apparatuses are classified as electrophotographic apparatuses, inkjet-type apparatuses, or dye diffusion thermal transfer type apparatuses. The printing unit includes a plurality of rollers which perform various functions, such as printing an image and conveying the printable media.

A predetermined temperature or pressure is applied to the rollers, and the rollers rotate in contact with an object. As a result, the mechanical and chemical lifetime of the rollers is limited. If the lifetime of the rollers is shorter than that of the image forming apparatus in which they are installed, the rollers may need to be replaced many times over the course of the lifetime of the image forming apparatus.

In order to attach and detach the rollers into and out of an image forming apparatus, the image forming apparatus includes a supporting member, which supports rotary shafts of the rollers, and a locking unit. The locking unit locks the rotary shaft of the roller onto the supporting member during attachment of the roller, and releases the rotary shaft during detachment of the roller. In addition, the locking unit prevents the rotary shaft of the roller from escaping from a predetermined position when the image forming apparatus operates, and also keeps the rollers firmly attached to the supporting member in case the image forming apparatus is dropped, or external shocks are applied thereto.

The time and costs required to manage, repair and replace an image forming apparatus increase as the structures of the supporting member and the locking unit become more complex. Moreover, a general user of the image forming apparatus should be able to replace the rollers easily.

If the supporting member and the locking unit are not firmly installed, some elements may be damaged when a user attaches and detaches the rollers, and the image forming apparatus may not satisfy a quality standard in dropping or shock tests.

SUMMARY OF THE INVENTION

Aspects of the present invention provide an image forming apparatus including a locking unit which locks a rotary shaft of a roller onto a main body of the image forming apparatus, wherein the locking unit has a high strength level and improved assembling characteristics, in order to prevent damages caused by dropping the apparatus or applying external shocks to the apparatus, as well as make the roller easily attachable and detachable.

According to an aspect of the present invention, there is provided an image forming apparatus including a main body, a roller detachably attached to the main body, a supporting member which supports a rotary shaft of the roller, and a locking unit including a locker frame fixed on the main body, a locker arm movably coupled to the locker frame which moves between a locking position when the rotary shaft is locked on the supporting member and a releasing position when the locking of the rotary shaft is released, and an elastic member which applies an elastic force to the locker arm to return the locker arm to the locking position.

The supporting member may include a first bush, in which a side of the rotary shaft is inserted in an axial direction, and a second bush having a U-shaped opening, in which the other side of the rotary shaft is inserted, wherein the locking unit locks the other side of the rotary shaft into the U-shaped opening.

The locker arm may include a barrier which prevents the rotary shaft from moving toward the opening at the locking position, and an inclined portion which pushes the rotary shaft towards the opening when the locker arm moves to the releasing position.

The locker frame may include a first guide portion that is inserted into a guide rail disposed on the locker arm which guides the guide rail in the locking/releasing direction.

The locker arm may include a second guide portion that guides the locker arm while contacting a portion of the main body.

The locking unit may be fixed on the main body at a predetermined position by a coupling member which couples the locker frame to the main body.

The first bush and the second bush may be elastically biased in the radial direction of the roller so that the roller can press an opposing medium.

The locker arm may include a predetermined marginal space so that the rotary shaft can move under the barrier when the first and second bushes are moved from the locking position.

The supporting member may further include a stopper which controls the movements of the first and second bushes.

The roller may be a transfer roller and an opposing medium may be a photosensitive medium.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become more apparent and more readily appreciated from the following description of the embodiments, taken in conjunction with the accompanying drawings of which.

DETAILED DESCRIPTION OF THE EMBODIMENTS

Figure 1:
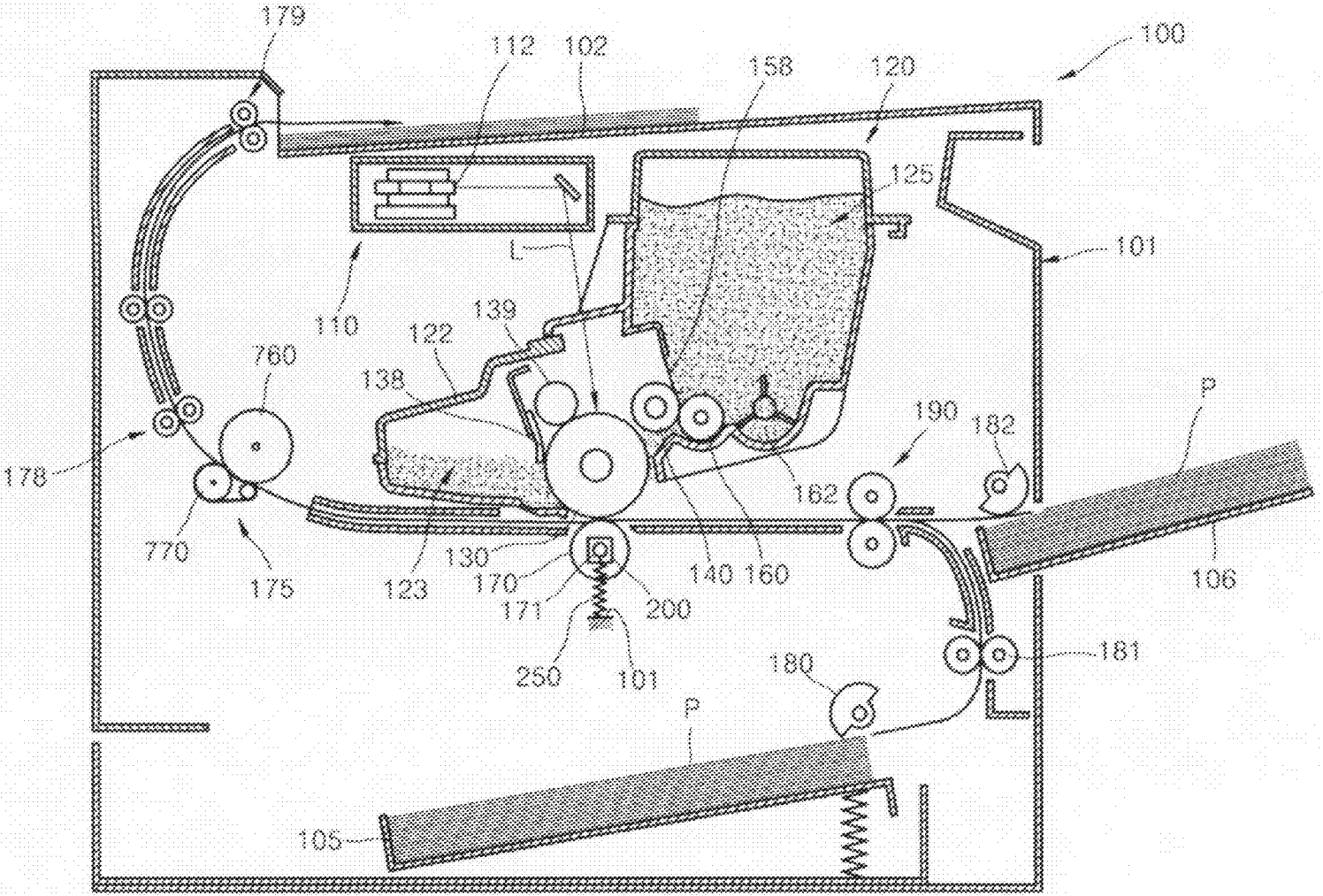
FIG. 1 is a cross-sectional view of an image forming apparatus according to an embodiment of the present invention.

Reference will now be made in detail to a present embodiment of the present invention, examples of which are illustrated in the accompanying drawings, wherein like reference numerals refer to the like elements throughout. The embodiments are described below in order to explain the present invention by referring to the figures.

FIG. 1 is a cross-sectional view of an electrophotographic image forming apparatus 100 according to an embodiment of the present invention. The electrophotographic image forming apparatus 100 is an example of an image forming apparatus including a locking unit. The electrophotographic image forming apparatus 100 includes a printing unit which prints a toner image onto a printable medium and a main body 101 in which the printing unit is installed. The main body 101 forms an outer frame of the image forming apparatus 100. The printing unit includes paper cassettes 105 and 106, a light scanning unit 110, a developing cartridge 120, and a fusing device 175.

The light scanning unit 110 scans light L corresponding to image information onto a photosensitive medium 130 to form an electrostatic latent image on an outer circumferential surface of the photosensitive medium 130. The light scanning unit 110 includes a light source (not shown) which radiates a laser beam, along with a beam polarizer 112 which polarizes the laser beam radiated from the light source.

The developing cartridge 120 is detachably installed in the main body 101. The developing cartridge 120 includes a developing roller 140 and the photosensitive medium 130 which faces the developing roller 140. A developing cartridge housing 122 forms an outer frame of the developing cartridge 120. The housing 122 includes the photosensitive medium 130, a charging roller 139, a cleaning member 138, the developing roller 140, a toner layer controlling member 158, a supplying roller 160, and an agitator 162. The developing cartridge also includes a waste toner storage 123 which stores waste toner separated from the photosensitive medium 130 by the cleaning member 138, and a toner storage 125 which stores the toner. The developing cartridge 120 is replaced with a new toner storage unit when the toner received in the toner storage 125 is exhausted.

The photosensitive medium 130 rotates in a predetermined direction and is installed so that a part of its outer circumferential surface is exposed. A photoconductive material layer is coated on the outer circumferential surface using a deposition method. The photosensitive medium 130 is charged to a predetermined potential voltage by the charging roller 139, and an electrostatic latent image corresponding to the image to be printed is formed on the outer circumferential surface of the photosensitive medium 130 by the light L radiated from the light scanning unit 110.

The developing roller 140 receives powder toner and supplies the powder toner to the electrostatic latent image formed on the photosensitive medium 130 in order to develop the image into a toner image. A developing bias voltage is applied to the developing roller 140 to supply the toner to the photosensitive medium 130. Outer circumferential surfaces of the developing roller 140 and the photosensitive medium 130 contact each other to form a developing nip, or in the alternative, are separated from each other to form a developing gap. Both the developing nip and the developing gap should be formed constantly along axial directions of the developing roller 140 and the photosensitive medium 130.

The supplying roller 160 supplies the toner to the developing roller 140 so that the toner can be attached onto the developing roller 140. The agitator 162 agitates the toner in the toner storage 125 and conveys the toner toward the supplying roller 160. The toner layer controlling member 158 controls the thickness of the toner attached on the outer circumferential surface of the developing roller 140.

The cleaning member 138 is installed in the housing 122 and contacts the photosensitive medium 130 with a predetermined pressure in order to scratch off the toner remaining on the photosensitive medium 130 after transferring the image.

The transfer roller 170 contacts the outer circumferential surface of the photosensitive medium 130, and receives a transfer bias voltage which has an opposite polarity of that of the toner image so that the toner image developed on the photosensitive medium 130 can be transferred onto a printable medium P. The toner image is transferred onto the printable medium P by both an electrostatic force as well as by mechanical contact between the photosensitive medium 130 and the transfer roller 140. An inner circumferential surface of the transfer roller 170 may be a metal sleeve, and an elastic layer may be deposited on the outer circumferential surface of the transfer roller 170.

The printable medium P passes between the facing surfaces of the transfer roller 170 and the photosensitive medium 130. The rotary shaft 171 of the transfer roller 170 can be moved toward the photosensitive medium 130 using an elastic force in order to press the printable medium P. This elastic force will enable the photosensitive medium 130 to adjust to the thickness variation of the printable medium P. Therefore, a bush 200 which supports the rotary shaft 171 of the transfer roller 170 is movably installed on the main body 101 of the image forming apparatus, and a compression spring 250 applies an elastic force to the bush 200. Since the elastic force is applied to the transfer roller 170, and since the photosensitive medium 130 and the transfer roller 170 contact each other during rotation, the transfer roller 170 wears out over time. When the transfer roller 170 becomes worn out, the transfer roller 170 needs to be separated from the main body 101 of the image forming apparatus 100 and replaced with a new transfer roller.

The fusing device 175 includes a heating roller 760 and a pressing roller 770 which faces the heating roller 760. The fusing device fuses the toner image onto the printable medium P using heat and pressure.

A de-curl portion 178 removes curls of the printable medium P which have been generated by the heat of the fusing device 175. A discharge roller 179 discharges the printable medium P, on which the image is fused, out of the image forming apparatus 100. After the printable medium P has been discharged out of the image forming apparatus 100, the printable medium P is loaded onto a discharge board 102.

The printable medium P moves through the image forming apparatus as follows. The image forming apparatus 100 includes a first paper cassette 105 and a second paper cassette 106. Printable media P are typically loaded onto both of these cassettes. Pickup rollers 180 and 182 pull the printable medium P one by one. A conveying roller 181 conveys the picked printable medium P toward a paper aligning device 190. The paper aligning device 190 aligns the printable medium P before the printable medium P passes between the photosensitive medium 130 and the transfer roller 170 so that the toner image can be transferred to a desired position on the printable medium P.

Although it is not shown in the drawings, a plurality of developing cartridges is required in order to print the full-color image using the electrophotographic method. When a plurality of photosensitive media and transfer rollers is installed, the rotary shafts of the transfer rollers can be moved in order to deal with the transfer process and the thickness variation of the various types of printable media, and the elastic force is applied to the transfer rollers toward the photosensitive media. The transfer rollers that are worn out are replaced with new transfer rollers. However, the present embodiment can be applied to any kind of roller which wears out and is detachably installed in the main body of the image forming apparatus 100, and is not limited to transfer rollers. The locking unit according to aspects of the present invention can also be installed on a roller conveying a printable medium.

Figure 2:
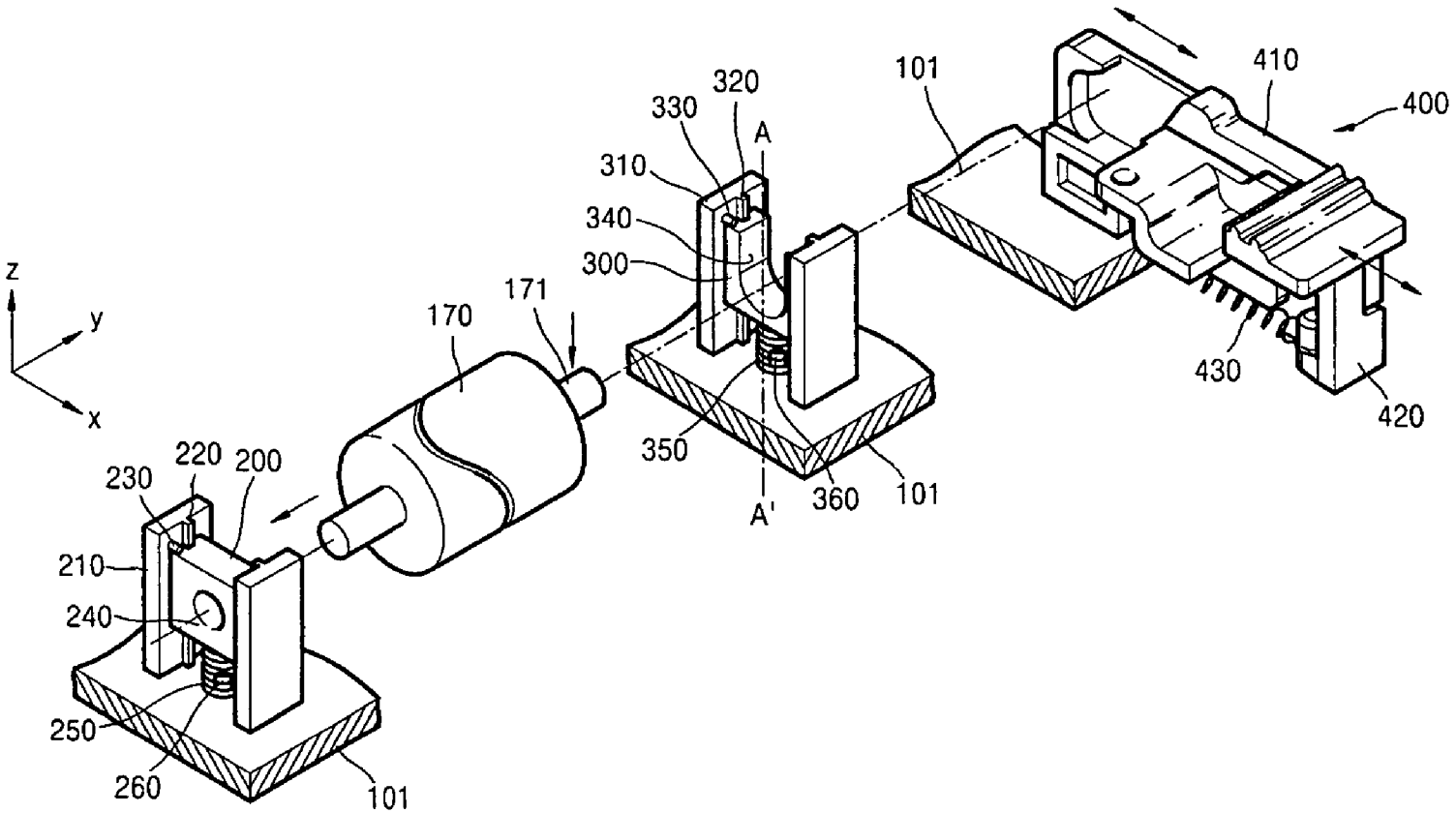
FIG. 2 is a perspective view of a roller, a supporting member, and a locking unit of the image forming apparatus of FIG. 1, according to an embodiment of the present invention.
Figure 3:
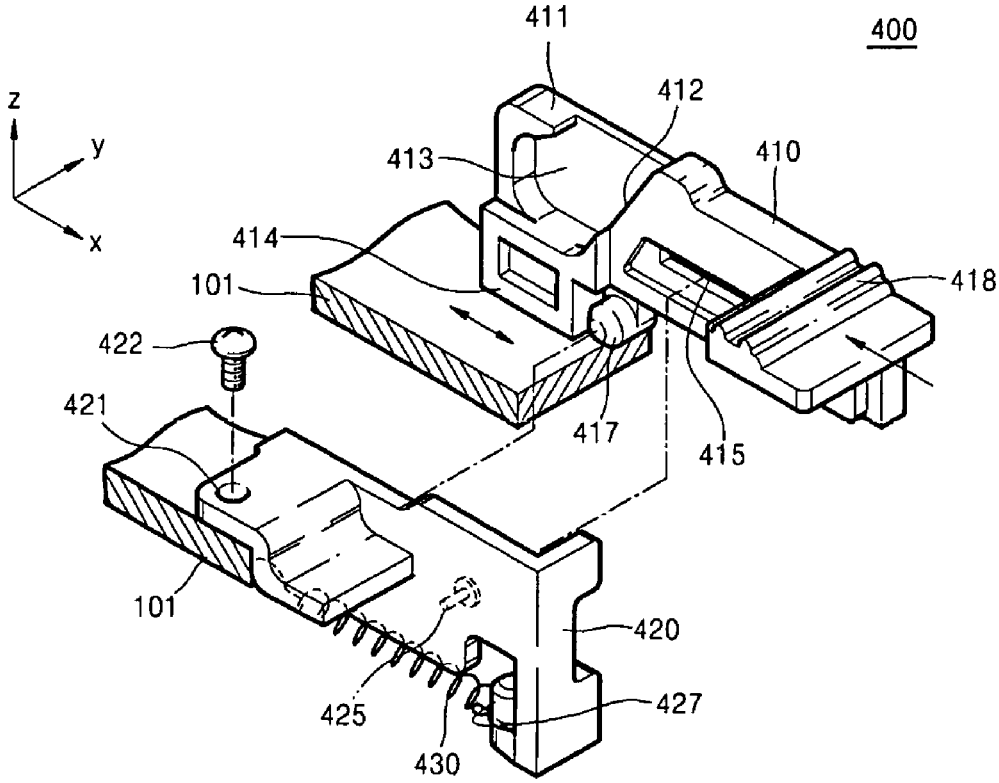
FIG. 3 is a perspective view of the locking unit in the image forming apparatus of FIG. 1, according to an embodiment of the present invention.

FIG. 2 is a perspective view of the roller 170, the supporting member, and the locking unit 400, according to an embodiment of the present invention. FIG. 3 is a perspective view of the locking unit 400 according to an embodiment of the present invention. In the present embodiment, the roller 170 is a transfer roller. However, the present invention is not limited to this embodiment, and can be applied to various kinds of rollers included in the main body 101 of the image forming apparatus 100.

The roller 170 is detachably installed in the main body 101 of the image forming apparatus. The rotary shaft 171 protrudes out from both sides of the roller 170. The supporting member supports the rotary shaft 171 of the roller 170. During operation, the roller is positioned along an axis of rotation. Although it is not shown in the drawings, a lubrication unit such as a lubricant or a sliding bearing may be disposed on surfaces of the supporting member which contact the rotary shaft 171. The supporting member includes a first bush 200, a second bush 300, fixing boards 210 and 310, and stoppers 230 and 330.

The first bush 200 includes a circular insertion hole 240, into which a side of the rotary shaft 171 is inserted. One side of the rotary shaft 171 is inserted into the insertion hole 240 along the direction of the y-axis, in other words, along the axial direction of the rotary shaft 171. The second bush 300 includes an opening 340 of a U shape, into which the other side of the rotary shaft 171 is inserted. The first and second bushes 200 and 300, respectively, are also referred to as first and second elements, respectively. The other side of the rotary shaft 171 is inserted into the opening 340 along the direction of the z-axis, in other words, in a radial direction. When the roller 170 is installed, a side of the rotary shaft 171 is inserted into the insertion hole 240 along the direction of the y-axis, and the other side of the rotary shaft 171 is pushed toward the opening 340 along the direction of the z-axis. The roller 170 can be separated by performing the same operations in reverse order.

The fixing boards 210 and 310 are fixed on the main body 101 of the image forming apparatus. Fixing board guides 220 and 320 can be disposed on the fixing boards 210 and 310. The fixing board guides 220 and 320 guide the first and second bushes 200 and 300 in the direction of the z-axis. Compression springs 250 and 350 are disposed between the first and second bushes 200 and 300 and the main body 101 of the image forming apparatus. First sides of the compression springs 250 and 350 are inserted into compression spring bosses 260 and 360 and then fixed on the main body 101 of the image forming apparatus. Second sides of the compression springs 250 and 350 make contact with the lower sides of the first and second bushes 200 and 300. The first and second bushes 200 and 300 are elastically biased by the compression springs 250 and 350 along the direction of the z-axis, in other words, in a radial direction of the rotary shaft 171.

Stoppers 230 and 330 are disposed on the fixing boards 210 and 310 to block the movements of the first and second bushes 200 and 300 in the z direction. The roller 170 is installed on the main body 101 of the image forming apparatus at the position where the movements of the first and second bushes 200 and 300 are stopped by the stoppers 230 and 330. When an opposing medium contacts the roller 170, the roller 170 moves in the −z direction along the z-axis and applies an elastic force to the opposing medium. In other words, the roller 170 which is inserted into the first and second bushes 200 and 300 can move in the radial direction, and can apply the elastic force of the compression springs 250 and 350 to the opposing medium.

If the roller 170 is a transfer roller and the opposing medium is a photosensitive medium (e.g., 130 of FIG. 1), the toner image is transferred onto the printable medium by the contacting force. In addition, when printable media of different thicknesses pass between the facing surfaces of the transfer roller 170 and the photosensitive medium 130, the transfer roller 170 adjusts its position according to the thickness of the printable medium.

The locking unit 400 includes a locker arm 410 and a locker frame 420. This locking unit 400 is also called a release mechanism. The locker arm 410 can move between a locking position and a releasing position. The rotary shaft 171 is locked on the supporting member at the locking position and restricted from moving in the direction of the x-axis or z-axis. Although it is not shown in the drawings, an additional locking unit for locking the rotary shaft 171 along the direction of the y-axis is disposed. Therefore, when the locking unit 400 is in the locking position, the movement of the rotary shaft 171 is restricted in the x, y, and z directions. For example, one end of the rotary shaft 171 is locked by a marginal space 413 along the direction of the y-axis. The other end of the rotary shaft 171 is locked by the additional locking unit (not shown) disposed at the outer side of the insertion hole 240 of the first bush 200, along the direction of the y-axis.

The locking unit 400 releases the rotary shaft 171 when the locking unit is moved into the releasing position. When a user moves the locker arm 410 into the releasing position, one side portion of the rotary shaft 171 is lifted from the opening 340 and the other side portion of the rotary shaft 171 is pulled out of the insertion hole 240, and thus, the roller 170 can be separated from the main body 101 of the image forming apparatus.

The locker frame 420 is fixed on the main body 101 of the image forming apparatus. The locker arm 410 is coupled to the locker frame 420 such that the locker arm 410 is movable in the direction along the x-axis. The locker arm 410 is elastically biased to the locking position. In the present embodiment, the locker arm 410 is elastically biased to the locking position by a tensile spring 430, both ends of which are fixed on tensile spring bosses 417 and 427 which are disposed on the locker arm 410 and the locker frame 420, respectively. Other types of elastic materials may be used to bias the locker arm 410 into the locking position. When a user pushes the locker arm 410, the locker arm 410 moves to the releasing position and the rotary shaft 171 is released from the locking position.

The locking unit 400 is fixed on a predetermined position of the main body 101 of the image forming apparatus by a coupling member 422 that penetrates through a coupling hole 421 formed on the locker frame 420. A protruding step is formed on the locker frame 420 around the coupling hole 421, and is engaged with the main body 101 around the coupling hole 421. This configuration, in which the coupling member 422 is coupled to the frame 420, prevents rotation of the locker frame 420. The locking unit 400 can be installed on the main body 101 of the image forming apparatus by one coupling operation which couples the locker arm 410 to the locker frame 420 creating an assembling structure of the locking unit 400 which is simple and allows the user to easily replace the roller 170. In addition, the costs and time for maintenance are reduced when the roller 170 is replaced in a quick and easy fashion, and satisfaction for the quality of the apparatus is improved. The locking unit 400 is installed adjacent to the second bush 300 which has the opening 340, and locks the rotary shaft 171 into the opening 340.

A barrier 411 and an inclined portion 412 are formed on the locker arm 410. When the locker arm 410 moves to the locking position, the barrier 411 contacts an upper end portion of the rotary shaft 171 to prevent the rotary shaft 171 from moving toward the opening 340. When the locker arm 410 moves to the releasing position, the inclined portion 412 pushes a lower portion of the rotary shaft 171 upward to move the rotary shaft 171 toward the opening 340.

A side surface of the locker arm 410 is guided by a coupling of a first guide portion 425 and a guide rail 415. The first guide portion 425 is disposed on a side surface of the locker frame 420, and the guide rail 415 is disposed on a side surface of the locker arm 410. The first guide portion 425 is movably inserted into the guide rail 415. In addition, a second guide portion 414 formed on the locker arm 410 is moved while being supported by the main body 101 of the image forming apparatus. The barrier 411, the inclined portion 412, the first guide portion 425, the second guide portion 414, and the guide rail 415 are all designed to have sufficient strength to prevent damage to the image forming apparatus caused by dropping the image forming apparatus or applying external shocks to it.

Figure 4:
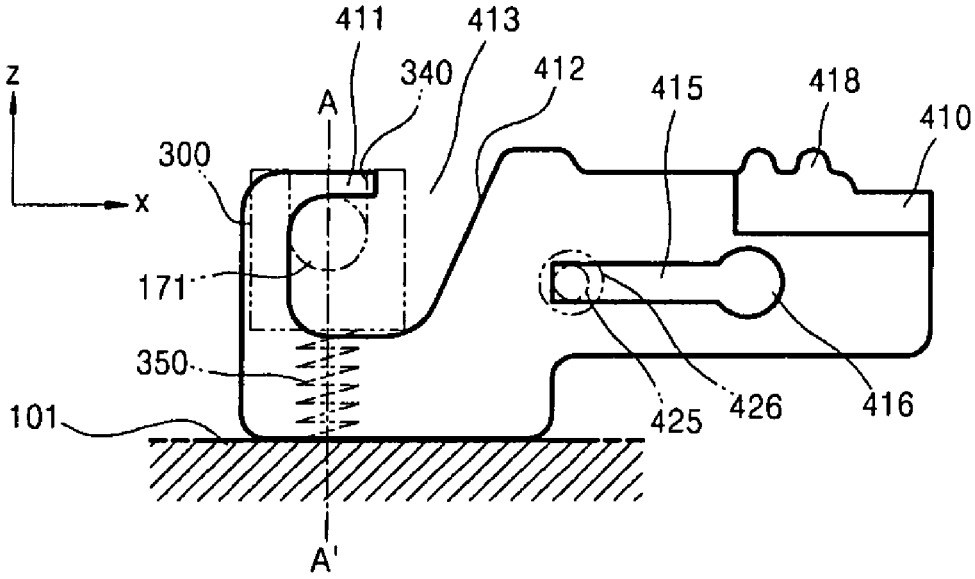
FIG. 4 is a side view of a locker arm at a locking position in the image forming apparatus of FIG. 1, according to an embodiment of the present invention.

Operations of the locking unit 400 will be described with reference to FIGS. 4 through 6. FIG. 4 is a side view of the locker arm 410 at the locking position. The second bush 300 and the rotary shaft 171 move in the radial direction along the line A-A'. Before installing the locking unit 400 on the main body 101 of the image forming apparatus, the locker arm 410, the locker frame 420, and the tensile spring 430 are coupled to each other. The first guide portion 425 and a rail fixing plate 426 disposed on the side surface of the locker frame 420 are inserted through a hole 416 formed in the locker arm 410. The rail fixing plate 426 contacts a side of the guide rail 415 so that the locker arm 410 does not drift in the direction of the y-axis. In the locking position, an upper portion of the rotary shaft 171 contacts the barrier 411, a lower portion of the rotary shaft 171 contacts a curved surface of the opening 340, and both sides of the rotary shaft 171 contact both side surfaces of the opening 340.

Figure 5:
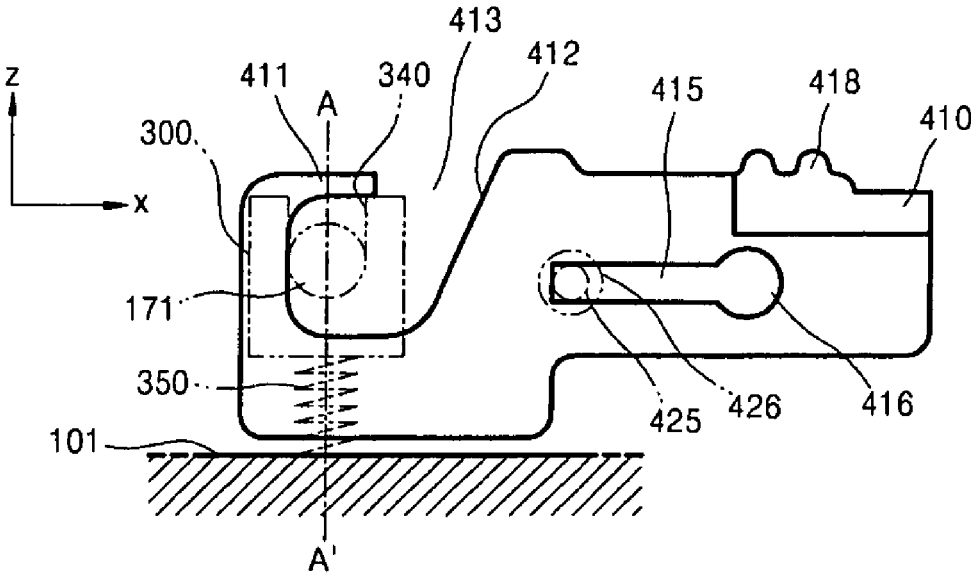
FIG. 5 is a side view of the locker arm which moves in a marginal space, according to an embodiment of the present invention.

FIG. 5 is a side view illustrating the locker arm 410 which moves in a marginal space 413. The transfer roller 170 elastically moves along the −z direction while contacting the opposing medium. For example, the transfer roller 170 elastically moves in the −z direction while contacting the photosensitive medium 130. The transfer roller 170 presses the outer circumferential surface of the photosensitive medium 130, and moves according to the thickness of the printable medium passing through the facing surfaces. When the photosensitive medium 130 elastically pushes the roller 170, the upper end portion of the rotary shaft 171 is separated from the barrier 411. The locker arm 410 should have a marginal space 413 in which the rotary shaft 171 can move in the radial direction after the locker arm 410 is separated from the barrier 411. In other words, the locker arm 410 may include the marginal space 413, in which the rotary shaft 171 can move under the barrier 411 from the locking position when the first and second bushes 200 and 300 are elastically moved by an opposing medium.

Figure 6:
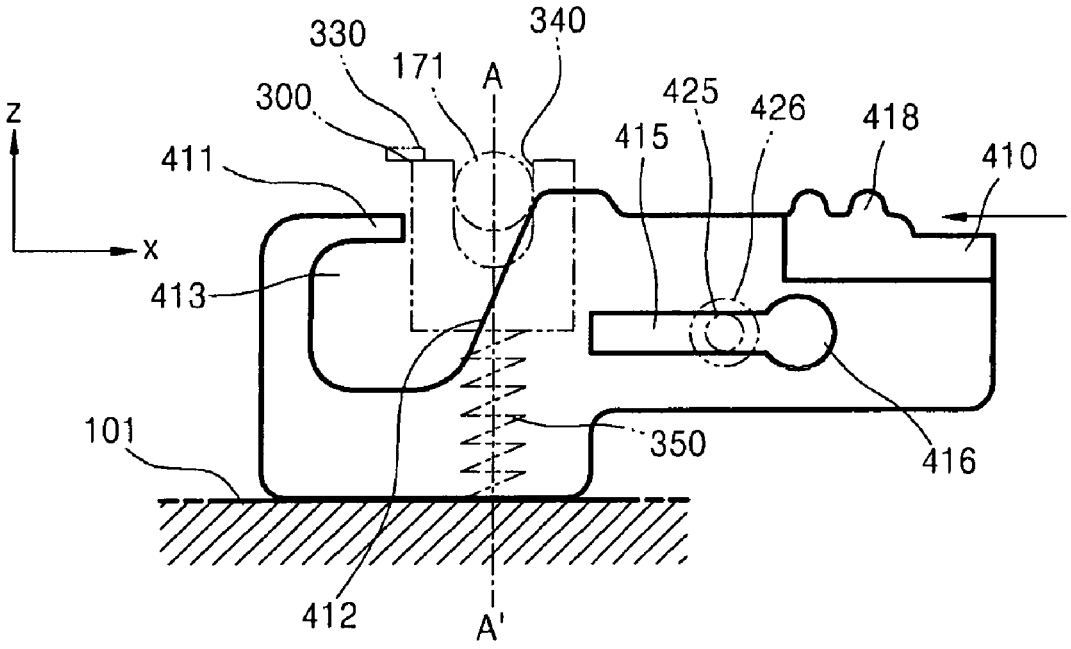
FIG. 6 is a side view of the locker arm in a release position in the image forming apparatus of FIG. 1, according to an embodiment of the present invention.

FIG. 6 is a side view of the locker arm 410 at the releasing position. The roller 170 can be separated from the main body 101 of the image forming apparatus to maintain, repair or replace the roller 170. When the locker arm 410 moves to the releasing position, the locking of the rotary shaft 171 is released and the roller 170 can be separated from the main body 101. When the user pushes a handle 418 in the −x direction, the locker arm 410 overcomes the elastic force of the tensile spring 430 and is moved into the releasing position. Then, the inclined portion 412, i.e., the angled side surface, is moved in the −x direction, and the lower portion of the rotary shaft 171 is lifted up as it slides along the inclined portion 412. The second bush 300 is stopped by the stopper 330 and is therefore prevented from moving along the direction of the z-axis. When the inclined portion 412 moves further, the rotary shaft 171 can be separated from the opening 340. When the rotary shaft 171 is pulled out of the insertion hole 240 of the first bush 200, the roller 170 can be separated from the main body 101 of the image forming apparatus.

According to aspects of the image forming apparatus of the present invention, a locking unit can be easily installed on the main body of the image forming apparatus in a state where the elements are assembled in the locking unit in advance, and thus, the assembling processes are simple and the user can easily install the locking unit. Additionally, aspects of the present invention reduce the costs and time required to maintain, repair and replace the roller, increasing the user's satisfaction. Furthermore, the image forming apparatus according to aspects of the present invention reinforces the strength of the locking unit and therefore prevents damage to the locking unit caused by dropping or external shocks.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a main body;

a roller detachably attached to the main body;

a supporting member which supports a rotary shaft of the roller, the supporting member comprising a first bush, in which a side of the rotary shaft is inserted in an axial direction of the roller, and a second bush having an opening, in which another side of the rotary shaft is inserted into in a radial direction of the roller, the first bush and the second bush being elastically biased in a radial direction of the roller so that the roller presses against an opposing medium; and a locking unit, comprising a locker frame fixed on the main body, a locker arm movably coupled to the locker frame which moves between a locking position in which the another side of the rotary shaft is locked on the supporting member and a releasing position where locking of the another side of the rotary shaft is released, a barrier which prevents the another side of the rotary shaft from being ejected from the second bush through the opening when the locker arm is in the locking position, an elastic member which applies an elastic force to the locker arm to return the locker arm to the locking position.

2. The image forming apparatus of claim 1, wherein the opening is U-shaped.

3. The image forming apparatus of claim 2, wherein the barrier prevents the rotary shaft from moving toward the opening when the locker arm is in the locking position, and the locker arm comprises an inclined portion which pushes the rotary shaft toward the opening when the locker arm moves towards the releasing position.

4. The image forming apparatus of claim 3, wherein the locker frame comprises a first guide portion which is inserted into a guide rail disposed on the locker arm and guides the guide rail when the locker arm moves into and out of the locking position.

5. The image forming apparatus of claim 4, wherein the locker arm further comprises a second guide portion which is guided while contacting a portion of the main body.

6. The image forming apparatus of claim 5, further comprising a coupling member which couples the locker frame onto the main body at a predetermined position to fix the locking unit onto the main body.

7. The image forming apparatus of claim 3, wherein the locker arm comprises a predetermined marginal space so that the rotary shaft is movable under the barrier when contacting an opposing medium.

8. The image forming apparatus of claim 7, wherein the supporting member further comprises stoppers which control the movements of the first and second bushes.

9. The image forming apparatus of claim 8, wherein the roller is a transfer roller and the opposing medium is a photosensitive medium.

10. An image forming apparatus comprising:

a main body;

a roller which contacts an opposing medium;

a rotary shaft located on both ends of the roller;

a bush in which one end of the rotary shaft is inserted and which is pushed upwards by an elastic force;

a barrier which prevents upward movement of the bush when the rotary shaft is inserted into the bush;

a stopper located above the barrier which prevents the upward movement of the bush; and an angled side surface coupled to the barrier, wherein a first push of the angled side surface moves the barrier so that the bush moves upward into the stopper, and a second push of the angled side surface moves the rotary shaft upwards out of the bush.

11. The image forming apparatus of claim 10, wherein the rotary shaft is inserted into a U-shaped opening of the bush.

12. The image forming apparatus of claim 11, wherein the roller is a transfer roller and the opposing medium is a photosensitive medium.

13. An image forming apparatus, comprising:

a main body;

a roller having a rotary shaft aligned in a first direction;

a first element biasing one end of the rotary shaft in a second direction which is perpendicular to the first direction;

a second element biasing another end of the rotary shaft in the second direction; and a locking unit which prevents the other end of the rotary shaft from moving in the second direction, wherein the locking unit comprises a locker frame fixed on the main body;

a locker arm movably coupled to the locker frame which moves perpendicular to the first direction, between a locking position in which a rotational axis of the rotary shaft is aligned in the first direction and a releasing position in which the rotational axis deviates from the first direction; and an elastic member which applies an elastic force to the locker arm to return the locker arm to the locking position.

14. The image forming apparatus of claim 13, wherein the locker arm comprises:

a barrier which prevents the rotary shaft from moving toward an opening in the second element when the locker arm is in the locking position; and an inclined portion which pushes the rotary shaft toward the opening when the locker arm moves towards the releasing position.

15. The image forming apparatus of claim 13, wherein the locker frame comprises a first guide portion which is inserted into a guide rail disposed on the locker arm and guides the guide rail when the locker arm moves into and out of the locking position.

16. The image forming apparatus of claim 15, wherein the locker arm further comprises a second guide portion which is guided while contacting a portion of the main body.

17. The image forming apparatus of claim 13, further comprising a coupling member which couples the locker frame onto the main body at a predetermined position to fix the locking unit onto the main body.

18. The image forming apparatus of claim 13, wherein the first and second elements are elastically biased in a radial direction of the roller.

19. The image forming apparatus of claim 18, wherein the locker arm comprises a predetermined marginal space so that the rotary shaft is movable under the barrier when contacting an opposing medium.

20. The image forming apparatus of claim 19, wherein the roller is a transfer roller and the opposing medium is a photosensitive medium.

21. An image forming apparatus comprising:

a roller having a rotary shaft positioned along an axis of rotation;

a supporting member which supports both ends of the rotary shaft; and a locking unit which slideably engages one end of the rotary shaft and locks the rotary shaft in a direction of the axis of rotation when in a locking position, wherein the locking unit comprises:

a locker frame fixed on a main body of the image forming apparatus;

a locker arm movably coupled to the locker frame which moves between a locking position in which the rotary shaft is aligned with the axis of rotation and a releasing position in which the rotary shaft deviates from the axis of rotation; and an elastic member which applies an elastic force to the locker arm to return the locker arm to the locking position, wherein the roller is a transfer roller that is configured to contact a photosensitive medium.

22. The image forming apparatus of claim 21, wherein the locking unit slides in a direction perpendicular to the axis of rotation.

23. The image forming apparatus of claim 21, wherein the locker arm comprises:

a barrier which locks the one end of the rotary shaft into the locking unit when the locker arm is in the locking position; and an inclined portion which pushes the one end of the rotary shaft toward an opening when the locker arm moves towards the releasing position.

24. The image forming apparatus of claim 23, wherein the locker arm further comprises a second guide portion which is guided while contacting a portion of the main body.

25. The image forming apparatus of claim 23, wherein the locker arm comprises a predetermined marginal space so that the rotary shaft is movable under the barrier when contacting the photosensitive medium.

26. The image forming apparatus of claim 21, wherein the locker frame comprises a first guide portion which is inserted into a guide rail disposed on the locker arm and guides the guide rail when the locker arm moves into and out of the locking position.

27. The image forming apparatus of claim 21, further comprising a coupling member which couples the locker frame onto the main body at a predetermined position to fix the locking unit onto the main body.

28. The image forming apparatus of claim 21, wherein the supporting member includes first and second elements elastically biased in a radial direction of the roller.

* * * * *